US008186977B2

(12) United States Patent
Heinrichs

(10) Patent No.: US 8,186,977 B2
(45) Date of Patent: May 29, 2012

(54) PUMPING SYSTEM

(75) Inventor: Albrecht Heinrichs, Erkelenz (DE)

(73) Assignee: Aker Wirth GmbH, Erkelenz (DE)

( * ) Notice: Subject to any disclaimer, the term of this patent is extended or adjusted under 35 U.S.C. 154(b) by 566 days.

(21) Appl. No.: 11/918,310

(22) PCT Filed: Feb. 16, 2006

(86) PCT No.: PCT/EP2006/001400

§ 371 (c)(1),
(2), (4) Date: Dec. 3, 2007

(87) PCT Pub. No.: WO2006/108466

PCT Pub. Date: Oct. 19, 2006

(65) Prior Publication Data

US 2009/0038852 A1 Feb. 12, 2009

(30) Foreign Application Priority Data

Apr. 12, 2005 (DE) ..... 10 2005 016 884

(51) Int. Cl.
*F04B 11/00* (2006.01)
*F04B 17/00* (2006.01)

(52) U.S. Cl. ..... 417/539; 417/415

(58) Field of Classification Search ..... 417/521, 417/539, 415, 454; 92/73, 147
See application file for complete search history.

(56) References Cited

U.S. PATENT DOCUMENTS

| | | | | |
|---|---|---|---|---|
| 879,560 | A * | 2/1908 | Lepley | 417/536 |
| 2,131,749 | A * | 10/1938 | Ofeldt | 417/506 |
| 2,331,513 | A * | 10/1943 | Stahl et al. | 92/73 |
| 2,755,739 | A * | 7/1956 | Euwe | 417/539 |
| 2,899,247 | A * | 8/1959 | Clarkson | 92/73 |
| 4,009,971 | A * | 3/1977 | Krohn et al. | 417/43 |
| 4,118,151 | A | 10/1978 | Murakami et al. | |
| 2004/0028540 | A1 | 2/2004 | Peck | |
| 2004/0060717 | A1 | 4/2004 | Leppanen | |
| 2004/0213677 | A1 * | 10/2004 | Matzner et al. | 417/63 |
| 2004/0219040 | A1 * | 11/2004 | Kugelev et al. | 417/415 |

FOREIGN PATENT DOCUMENTS

| | | |
|---|---|---|
| DE | 32 44 822 | 8/1990 |
| GB | 1 034 058 | 5/1965 |

* cited by examiner

*Primary Examiner* — Devon C Kramer
*Assistant Examiner* — Peter J Bertheaud
(74) *Attorney, Agent, or Firm* — Norman B. Thot

(57) ABSTRACT

A pumping system for pumping drilling fluid during the driving or sinking of bore holes includes a pump unit, a rotary drive unit configured to drive the pump unit, a gearbox that includes a driving gear and a driven gear, and a pump shaft drive. The rotary drive unit is operatively connected with the pump unit via the gearbox, and the driven gear of the gearbox is nonrotatably connected with the pump shaft drive.

12 Claims, 2 Drawing Sheets

PUMPING SYSTEM

CROSS REFERENCE TO PRIOR APPLICATIONS

This application is a U.S National Phase application under 35 U.S.C. §371 of International Application No. PCT/EP2006/001400, filed on Feb. 16, 2006 and which claims benefit to German Patent Application No. 10 2005 016 884.1, filed on Apr. 12, 2005. The International Application was published in German on Oct. 19, 2006 as WO 2006/108466 A1 under PCT Article 21(2).

FIELD

The invention concerns a pumping system for pumping drilling fluid during the driving or sinking of bore holes, with a pump unit and with a rotary drive unit for driving the pump unit.

BACKGROUND

Especially during the driving or sinking of large-diameter bore holes, drilling fluid is fed to the bore hole during the drilling operation. On the one hand, the drilling fluid serves the purpose of lubricating the drilling tools operating at the heading face or at the bottom of the shaft and of supporting the heading face and the wall of the bore hole. On the other hand, the drilling fluid can also be used to bring dissolved drill cuttings out of the bore hole, for example, by feeding fresh drilling fluid centrally through a hollow drill string in the area of the bottom of the bore hole or in the area of the heading face, thereby producing a flow of drilling fluid, which entrains the dissolved drill cuttings and removes them from the bore hole.

The production of the drilling fluid flow necessary for bringing out the drilled material requires very heavy-duty pumping systems. The pumping capacity of these kinds of pumping systems is generally on the order of a maximum of 3,000 L/min at a maximum pressure of 500 bars.

The prior art describes pumping systems that are distinguished by especially compact construction, since the rotary drive unit of the pumping system that drives the pump unit is installed above the pump unit and is flange-mounted on the upper side of the pump housing. The rotary drive units generally have power ratings of up to 1,700 kW.

In order to be able to transmit this power or the torque delivered by the rotary drive unit to the input shaft of the pump unit, it is well known that both the shaft of the rotary drive and the drive shaft of the pump can be brought out of their respective housings at both ends, so that each shaft has two shaft ends. A sprocket wheel is nonrotatably supported on each shaft end. Accordingly, torque is transmitted by two chains that run parallel to each other.

A disadvantage of pumping systems of this type is the highly complex design necessitated by chains running on both sides, which requires doubling of the parts and especially four shaft bushings with corresponding sealing systems. In addition, the chain drives cause a high noise level during operation.

SUMMARY

An aspect of the present invention is to provide a pumping system that does not have the aforementioned disadvantages.

In an embodiment, the present invention provides a pumping system for pumping drilling fluid during the driving or sinking of bore holes which includes a pump unit, a rotary drive unit configured to drive the pump unit, a gearbox that includes a driving gear and a driven gear, and a pump shaft drive. The rotary drive unit is operatively connected with the pump unit via the gearbox and the driven gear of the gearbox is nonrotatably connected with the pump shaft drive.

BRIEF DESCRIPTION OF THE DRAWINGS

The present invention is described in greater detail below on the basis of embodiments and of the drawings in which.

DETAILED DESCRIPTION

Figure 1:
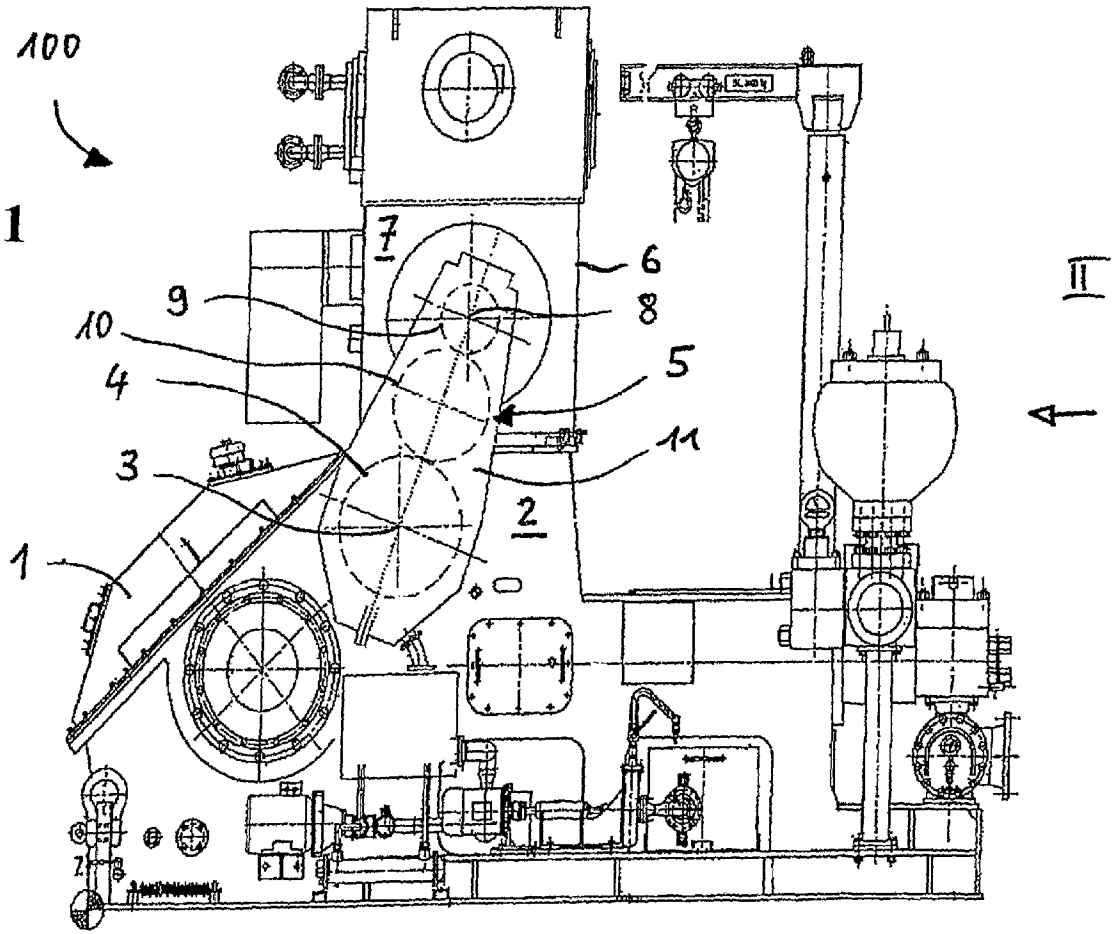
FIG. 1 shows a side view of the embodiment.
Figure 2:
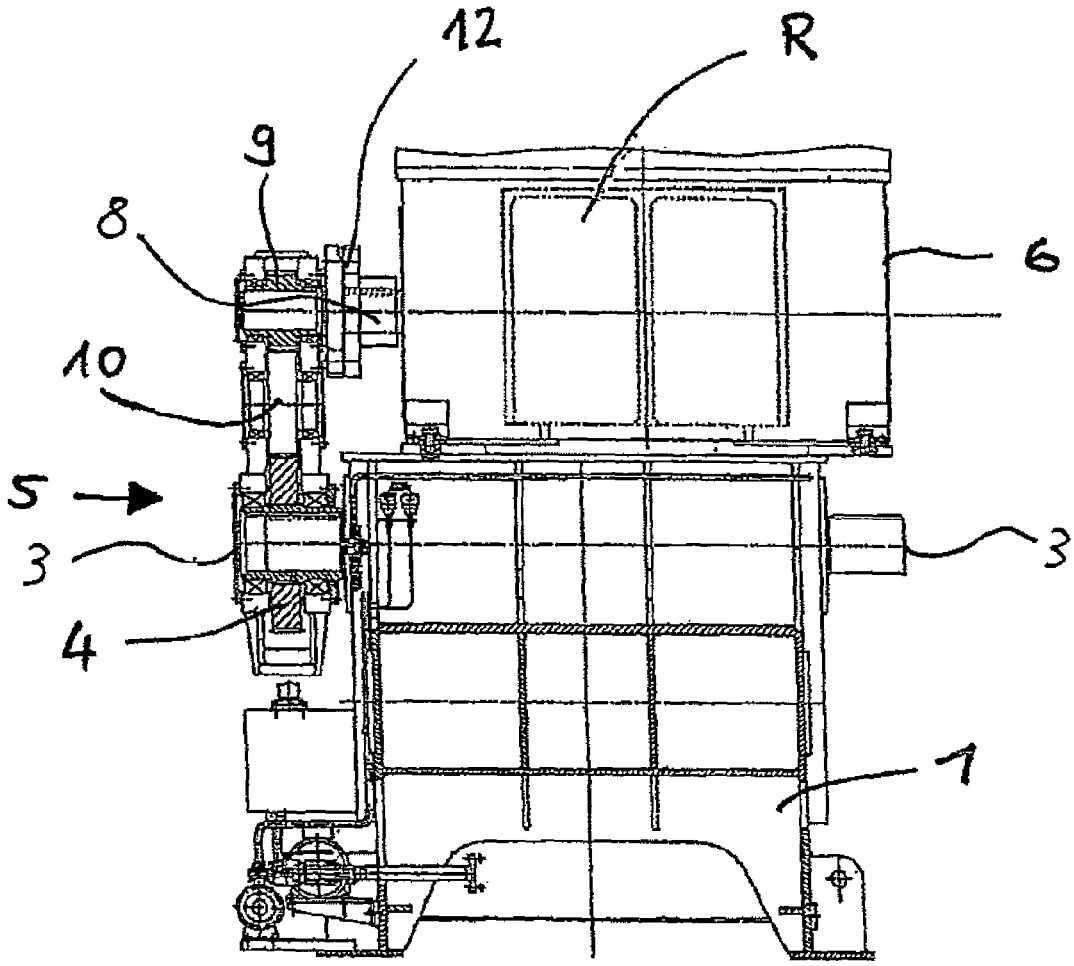
FIG. 2 shows the same embodiment in a partially cutaway front view (view 11 in FIG. 1).

The noise generation inherent in a chain drive is avoided by virtue of the fact that in the pumping system of the invention, the rotary drive unit is operatively connected with the pump unit via a gearbox that comprises a driving gear and a driven gear. Surprisingly, it was also found that to transmit the power and torque necessary to operate the pump unit, it is sufficient to provide a gearbox on only one side of the pumping system.

In an embodiment of the pumping system of the present invention, the rotary drive unit has only a single shaft end, with which the driving gear can be rotationally connected, for example, by a clutch.

The noise level produced by the gearbox can be further reduced if, for example, the gears that make up the gearbox are helical gears.

The pumping system 100 comprises a pump unit 1 of a conventional type. The pump unit 1 has a housing 2. One end of a pump drive shaft 3 extends from the side of the housing 2 which faces the observer. The driven gear 4 of a gearbox 5 is nonrotatably connected with this shaft end.

The gearbox 5 serves to produce the operative connection of the pump unit with a rotary drive unit 6, which comprises a rotary motor R, which, for example, is hydraulically or electrically driven, and is only schematically illustrated in the drawing.

The rotary drive unit 6 comprises a housing 7, which is flange-mounted on the housing 2 of the pump unit 1.

Again on the side that faces the observer, a shaft end of a driven shaft 8 extends from the housing 7 of the rotary drive unit 6. It is connected with a driving gear 9 by a clutch 12, which selectively connects or disconnects the driving gear 9 with the shaft end in a rotationally fixed manner. The driving gear 9 is coupled with the driven gear 4 by an intermediate gear 10, which is rotatably supported in a housing 11 of the gearbox. Instead of the clutch, it is also possible to provide an elastic, nonshiftable coupling that permanently connects the shaft end with the driving gear.

The teeth of the intermediate gear 10 mesh with the teeth of the driving gear 9 and the driven gear 4. For the purpose of noise reduction, the gears of the gearbox are helical gears.

The present invention is not limited to embodiments described herein; reference should be had to the appended claims.

The invention claimed is:

1. A pumping system for pumping drilling fluid during the driving or sinking of bore holes, the pumping system comprises:

a pump unit enclosed within a pump unit housing;

a single rotary drive unit configured to drive the pump unit;

a gearbox encasing a driving gear and a driven gear; and a pump drive shaft extending out of the pump unit housing, wherein the pump drive shaft is not a crank shaft, wherein the single rotary drive unit is operatively connected with the pump unit via the gearbox, the driven gear of the gearbox is nonrotatably connected with the pump drive shaft extending out of the pump unit housing, the single rotary drive unit is coupled to the to of said pump unit housing, and a longitudinal center line of the pump unit housing extends through said single rotary drive unit.

2. A pumping system as recited in claim 1, wherein the single rotary drive unit includes a single shaft end, with which the driving gear is rotationally connected.

3. A pumping system as recited in claim 2, wherein the driving gear is connected with the single shaft end by a coupling configured to selectively produce a rotationally fixed connection between the driving gear and the shaft end.

4. A pumping system as recited in claim 1, wherein the gears are helical gears.

5. A pumping system comprising:

a pump unit enclosed within a pump unit housing;

a single rotary drive unit configured to drive the pump unit;

a gearbox encasing a driving gear and a driven gear; and a pump drive shaft extending out of the pump unit housing, wherein the pump drive shaft is not a crank shaft, wherein the single rotary drive unit is operatively connected with the pump unit via the gearbox, the driven gear of the gearbox is nonrotatably connected with the pump drive shaft extending out of the pump unit housing, the single rotary drive unit is coupled to the to of said pump unit housing, and a longitudinal center line of the pump unit housing extends through said single rotary drive unit, and the pumping system is configured to pump drilling fluid during the driving or sinking of bore holes.

6. A pumping system as recited in claim 5, wherein the single rotary drive unit includes a single shaft end, with which the driving gear is rotationally connected.

7. A pumping system as recited in claim 6, wherein the driving gear is connected with the single shaft end by a coupling configured to selectively produce a rotationally fixed connection between the driving gear and the shaft end.

8. A pumping system as recited in claim 5, wherein the gears are helical gears.

9. A pumping system consisting of:

a pump unit enclosed within a pump unit housing;

a single rotary drive unit configured to drive the pump unit;

a gearbox encasing a driving gear and a driven gear; and a pump drive shaft extending out of respective opposite sides of the pump unit housing, wherein the pump drive shaft is not a crank shaft, wherein the single rotary drive unit is operatively connected with the pump unit via the gearbox, the driven gear of the gearbox is nonrotatably connected with the pump drive shaft extending out of the pump unit housing, the single rotary drive unit is coupled to the to of said pump unit housing, a longitudinal center line of the pump unit housing extends through said single rotary drive unit, and the pumping system is configured to pump drilling fluid during the driving or sinking of bore holes.

10. The pumping system as recited in claim 9, wherein the single rotary drive unit includes a single shaft end, with which the driving gear is rotationally connected.

11. The pumping system as recited in claim 10, wherein the driving gear is connected with the single shaft end by a coupling configured to selectively produce a rotationally fixed connection between the driving gear and the shaft end.

12. The pumping system as recited in claim 9, wherein the gears are helical gears.

* * * * *

UNITED STATES PATENT AND TRADEMARK OFFICE

CERTIFICATE OF CORRECTION

PATENT NO. : 8,186,977 B2
APPLICATION NO. : 11/918310
DATED : May 29, 2012
INVENTOR(S) : Albrecht Heinrichs It is certified that error appears in the above-identified patent and that said Letters Patent is hereby corrected as shown below:

In the Claims

In claim 1, column 3, line 5 “to the to” should read --to the top--.

In claim 5, column 3, line 27 “to the to” should read --to the top--.

In claim 9, column 4, line 18 “to the to” should read --to the top--.

Signed and Sealed this
Sixteenth Day of December, 2014

Michelle K. Lee

Michelle K. Lee
*Deputy Director of the United States Patent and Trademark Office*